United States Patent [19]

Harada

[11] 4,071,006

[45] Jan. 31, 1978

[54] EXHAUST GAS RECIRCULATING SYSTEM

[75] Inventor: Ietsuya Harada, Yokohama, Japan

[73] Assignee: Nissan Motor Co., Ltd., Yokohama, Japan

[21] Appl. No.: 713,617

[22] Filed: Aug. 11, 1976

[30] Foreign Application Priority Data

| | | |
|---|---|---|
| Aug. 12, 1975 | Japan | 50-110532 |
| Nov. 8, 1975 | Japan | 50-152780 |
| Nov. 8, 1975 | Japan | 50-152779 |

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 3,814,070 | 6/1974 | Wertheimer | 123/119 A |
| 3,885,536 | 5/1975 | Marshall | 123/119 A |
| 3,901,202 | 8/1975 | Hollis, Sr. | 123/119 A |
| 3,915,136 | 10/1975 | Caldwell | 123/119 A |
| 3,926,161 | 12/1975 | Wertheimer | 123/119 A |
| 3,962,868 | 6/1976 | Matumoto et al. | 123/119 A |
| 3,974,807 | 8/1976 | Nohira et al. | 123/119 A |
| 3,994,269 | 11/1976 | Takaoka et al. | 123/119 A |
| 4,002,154 | 1/1977 | Kestner | 123/119 A |
| 4,010,723 | 3/1977 | Suziki et al. | 123/119 A |
| 4,033,309 | 7/1977 | Hayashi et al. | 123/119 A |

*Primary Examiner*—Wendell E. Burns

[57] ABSTRACT

An internal combustion engine equipped with an exhaust gas recirculating system is provided. The exhaust gas recirculating system comprises an EGR valve normally closing an EGR duct to prevent recirculation and movable by a signal vacuum applied thereto to an open position and control means operable to provide a signal vacuum. The control means includes a vacuum line connecting a vacuum port communicating with the carburetor throttle bore above the idle speed position of the throttle valve to the EGR valve, air bleed means including a vent in the vacuum line and flow restricting means in the vacuum line fluidly intermediate the vacuum port and vent. The air bleed means includes an air bleed control valve movable into and out of the vent to close or open the same; spring means biasing the air bleed valve closed; servo means connected to the air bleed control valve for moving it to an open vent position in response to vacuum in the vacuum line intermediate the flow restricting means and EGR valve; means for biasing the servo means in response to the engine intake manifold vacuum in a direction to move the air bleed control valve to an open vent position; and means for biasing the biasing means to vary movement of the air bleed control valve to an open vent position.

19 Claims, 6 Drawing Figures

EXHAUST GAS RECIRCULATING SYSTEM

The present invention relates, in general, to an internal combustion engine. More particularly, it relates to an exhaust gas recirculating system.

Devices are known for recirculating a portion of the engine exhaust gases back through the engine to lower the emission of oxides of nitrogen. A known one of the devices has included an EGR valve normally closing an EGR duct to prevent recirculation and movable by a signal vacuum applied thereto to an open position and control means operable to provide a signal vacuum. The conventional control means includes a vacuum line connecting a vacuum port communicating with the carburetor throttle bore above the idle speed position of the throttle valve to the EGR valve and an air bleed device having a vent in the vacuum line. The air bleed device includes an air bleed control valve movable into and out of the vent to close or open the same, spring biasing the air bleed valve closed and servo means connected to the air bleed control valve for moving it to an open vent position in response to vacuum in the vacuum line. This EGR system has a problem that the vacuum applied to the EGR valve is great so as to permit excessive recirculation during coasting operation at high engine speed in which the throttle valve is slightly opened and during cruising operation ranging from 60km/h to 80km/h with the throttle valve is slightly opened. To eliminate this problem, it has been known to provide a mechanism which is so designed as to cause the EGR valve to close the EGR duct when the vehicle speed or engine speed is above a predetermined level. With this known method, recirculation is prevented during high vehicle speed or engine speed operation mode and the amount of recirculation abruptly changes as the vehicle enters or leave this operation mode, thereby to cause a loss in drivability.

It is an object of the present invention to provide an exhaust gas recirculating system that affords a control of the exhaust gas recirculation without a loss in drivability due to abrupt change in the exhaust gas recirculation.

Other objects and features of the present invention will become clearer from the following description taken in conjunction with the accompanying drawings, in which.

Figure 1:
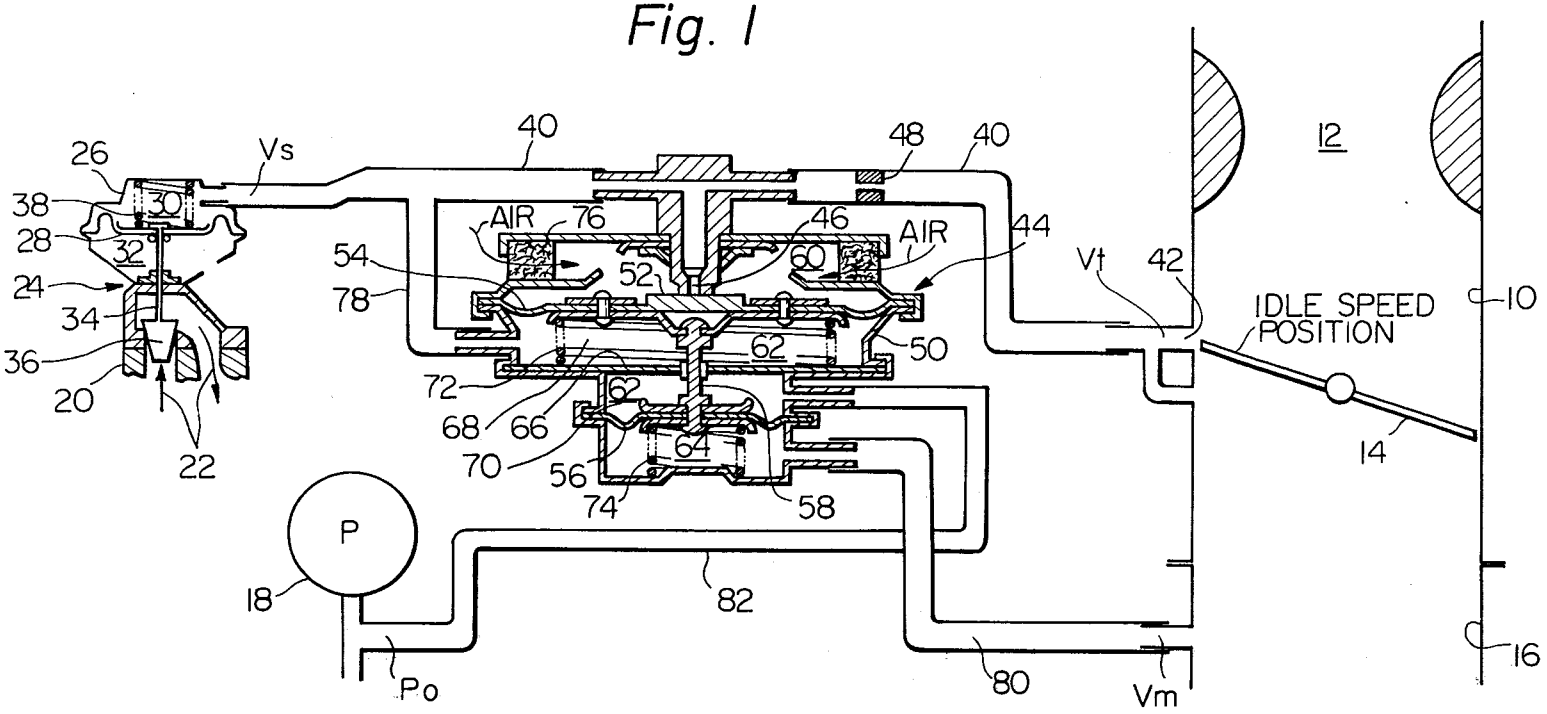
FIG. 1 illustrates schematically a first embodiment of an exhaust gas recirculating system according to the present invention.

Referring now to FIG. 1, there is schematically shown the first embodiment of an exhaust gas recirculating system according to the present invention. An internal combustion engine has an intake system that includes a carburetor throttle bore 10 provided with a venturi 12 and a throttle valve 14 and an intake manifold 16. The engine also includes an exhaust system (not shown) and a secondary air supply system, only an engine driven air pump 18 of the system being shown.

The exhaust gas recirculating (EGR) system comprises an exhaust gas recirculating (EGR) duct 20 connecting the engine exhaust gases in the exhaust system to the intake system, the recirculating exhaust gases through the EGR duct 20 being shown by arrows 22. An EGR valve, generally indicated at 24, is mounted to the EGR duct 20 and it normally closes the EGR duct 20 to prevent recirculation and movable by a signal vacuum ($V_s$) applied thereto to an open position.

The EGR valve 24 comprises a motor housing 26 having a circular diaphragm 28 dividing the former into a vacuum chamber 30 and an atmospheric chamber 32. A downwardly projecting valve stem 34 is centrally attached to the diaphragm 28. A conical valve member 36 is attached to the valve stem 34. A coiled spring 38 disposed in the vacuum chamber 30 serves to normally bias the diaphragm 28, the valve stem 34 and the valve member 36 to a closed position to prevent recirculation. The signal vacuum ($V_s$) is introduced into the vacuum chamber 30 to cause the valve member 36 to move to an open position.

Control means operable to provide a signal vacuum ($V_s$) to the EGR valve 24 includes a vacuum line 40 connecting a vacuum port 42 communicating with the throttle bore 10 above the idle speed position (the illustrated position) of the throttle valve to the vacuum chamber 30 of the EGR valve 24. The control means also includes air bleed means 44 including a vent 46 in the vacuum line 40 and a flow restricting means 48 in the vacuum line 40 fluidly intermediate the vacuum port 42 and the vent 46.

Figure 5:
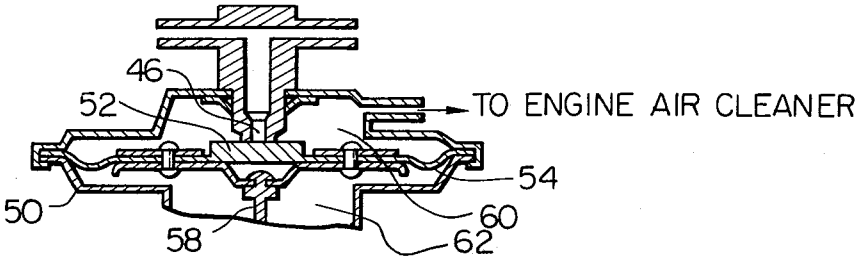
FIG. 5 illustrates a modification of an air bleed means.

The air bleed means 44 includes a casing 50, an air bleed control valve having a disc-like valve member 52 that cooperates with the vent 46 to vary the bleed of air to the vacuum line 40, and servo means connected to the air bleed control valve. The servo means comprises a relatively large, in effective area, diaphragm 54, a relatively small, in effective area, diaphragm 56 and a rod 58 interconnecting the large and small diaphragms 54 and 56. The diaphragms 54 and 56 are mounted in the casing 50 as shown. The large diaphragm 54 defines in the casing 50 a first chamber 60 into which the vent 46 projects. The large and small diaphragms 54 and 56 define therebetween and in the casing 50 a second chamber 62. The small diaphragm 56 defines in the casing 50 a third chamber 64. The second chamber 62 is divided by a partition 66 into a first subchamber 68 adjacent the large diaphragm 54 and into a second subchamber 70 adjacent the small diaphragm 56. The disc-like valve member 52 is fixed centrally to the large diaphragm 54. Spring 72 disposed in the first subchamber 68 and spring 74 disposed in the third chamber 64 serve to bias the disk-like valve member 52 to close the vent 46. The first chamber 60 communicates with the atmosphere by way of an air filter 76 to purify air to be bled into the vacuum line 40 via the vent 46. For the same end the first chamber 60 may be fluidly connected to the engine air cleaner (not shown) instead of employing the air filter 76, as shown in FIG. 5.

A conduit 78 fluidly connects the first subchamber 68 below the large diaphragm 54 to the vacuum line 40 at a location intermediate the vent 46 and the vacuum chamber 30 to introduce the signal vacuum ($V_s$) to the first subchamber 62. By so connecting the subchamber 62 to the vacuum line 40, the diaphragm 54 moves the disc-like valve 52 to an open vent position in response to the signal vacuum against the force of the springs 72 and 74. However this movement is varied because the third chamber 64 fluidly connected to the intake manifold 16 by a conduit 80 serves to bias the small diaphragm 56 in response to the manifold vacuum ($V_m$) in a direction to move the disc-like valve member 52 to an open vent position and the second subchamber 70 fluidly connected to the engine driven air pump 18 to introduce thereinto a compressed air serves to bias the small diaphragm 56 in response to the pump output pressure ($P_o$) in a direction to move the disc-like valve chamber 52 toward an open vent position. A conduit 82 connects the second subchamber 70 to the output or discharge side of the air pump 18.

Assuming now that vacuum at the vacuum port 42 ($V_t$), intake manifold vacuum ($V_m$) and pump output pressure ($P_o$) are fixed, when the disk-like valve member 52 is pulled downwardly from the position shown in FIG. 1 by the diaphragm 54 due to vacuum in the subchamber 68, it opens the vent 46 thereby bleeding air into the vacuum line 40 to reduce the vacuum in the subchamber 68. The reduction of the vacuum in the subchamber 68 by this action tends to cause the disc-like valve member 52 to be moved upwardly thereby subsequently closing the vent 46. An equilibrium is established whereby as the signal vacuum ($V_s$) a vacuum of a predetermined value is produced according to the upward face applied to the disc-like valve member 52.

It is to be noted that the flow restricting means 48 serves to delay the transmission of a change in $V_t$ to the subchamber 68 so that even if $V_t$ change abruptly, the corresponding change in $V_s$ to the abrupt change in $V_t$ will be moderate.

It is to be noted that because $V_s$ is transmitted to the subchamber 68 abrupt increase in $V_m$ or $P_o$ will not cause the corresponding abrupt reduction in $V_s$ but the reduction in $V_s$ will be gradual.

It will now be understood that during light load engine operation where intake manifold vacuum ($V_m$) is high or during high engine speed operation where pump output pressure ($P_o$) is high, signal vacuum ($V_s$) has a low value and reduction in $V_s$ to the low value is gradual.

Figure 2:
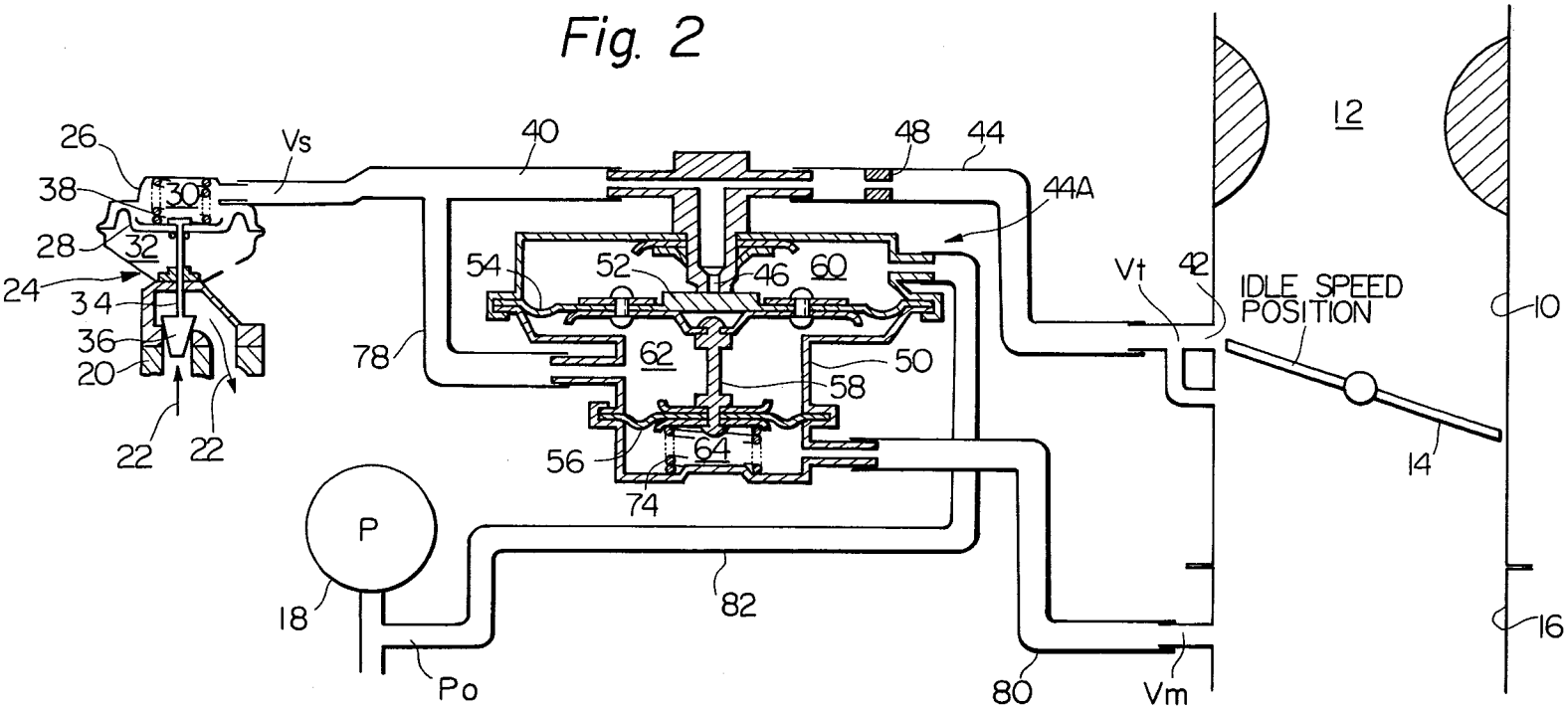
FIG. 2 illustrates a second embodiment of the present invention.

The second embodiment shown in FIG. 2 is basically similar to the first embodiment of FIG. 1, but different from the same in that it employs modified air bleed means 44A in which a second chamber 62 has eliminated the partition 66 and is fluidly connected to a vacuum line 40 at a location intermediate a vent 46 and a vacuum chamber 30 of an EGR valve 24 and a first chamber 60, which has communicated with the atmosphere in the case of FIG. 1, is fluidly connected to an engine driven air pump 18 to receive a compressed air therefrom while eliminating fluid connection of the chamber 62 with the pump 18 shown in FIG. 1.

The operation of the system shown in FIG. 2 is substantially similar to that of the system shown in FIG. 1.

Figure 3:
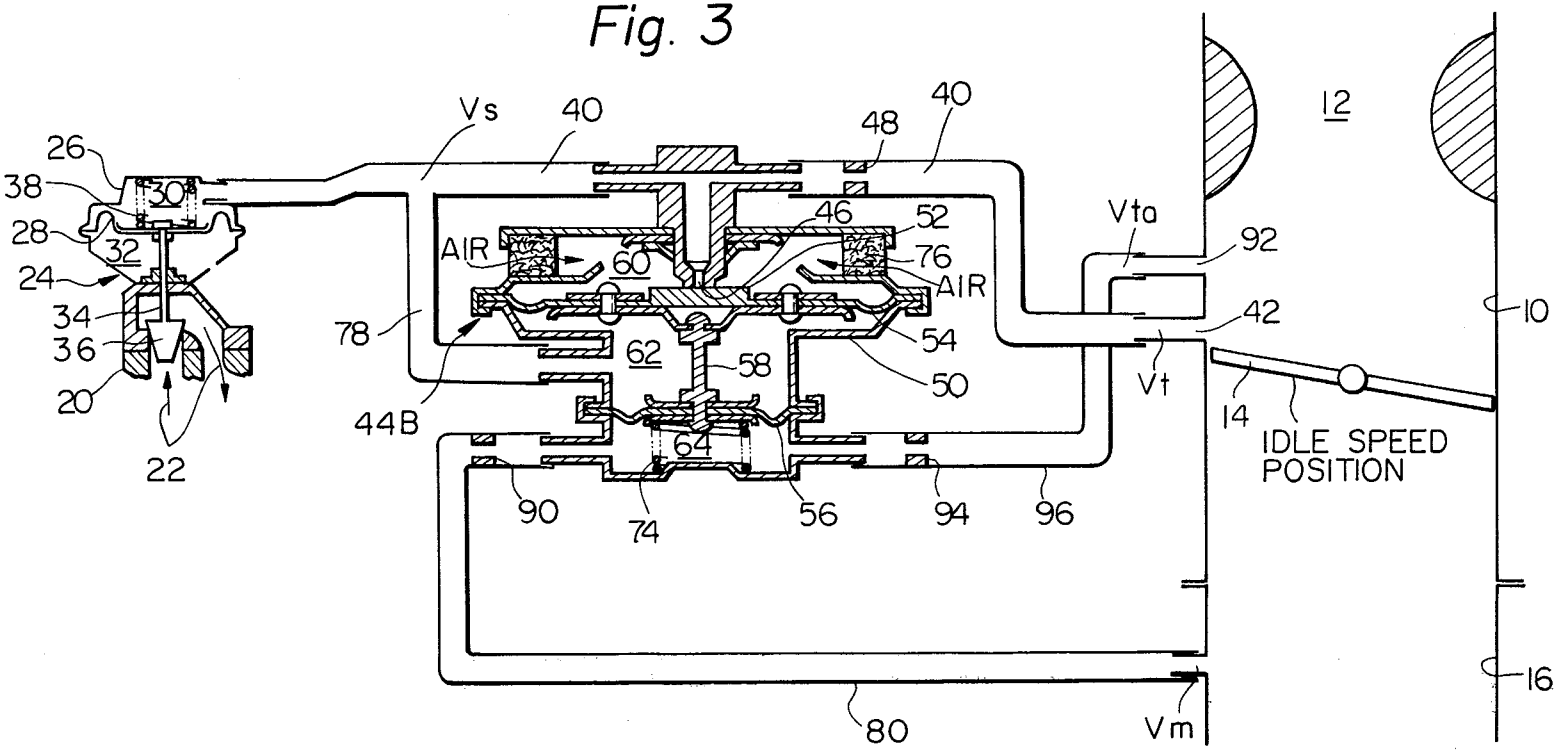
FIG. 3 illustrates a third embodiment of the present invention.

The third embodiment shown in FIG. 3 is different from the first embodiment in that modified air bleed means 44B is employed in which a second chamber 62 has eliminated the partition 66 and is fluidly connected to a vacuum line 40 at a location intermediate a vent 46 and a vacuum chamber 30 of an EGR valve 24 and the connection of the chamber 62 with the engine driven air pump 18 as shown in FIG. 1 has been eliminated. More specifically another difference is that a third chamber 64 is fluidly connected not only to an intake manifold 16 by way of a flow restricting means 90 but also to a second vacuum port 92 by way of a flow restricting means 94 provided in a conduit 96. The second vacuum port 92 communicates with a throttle bore 10 above a first vacuum port 42.

Figure 4:
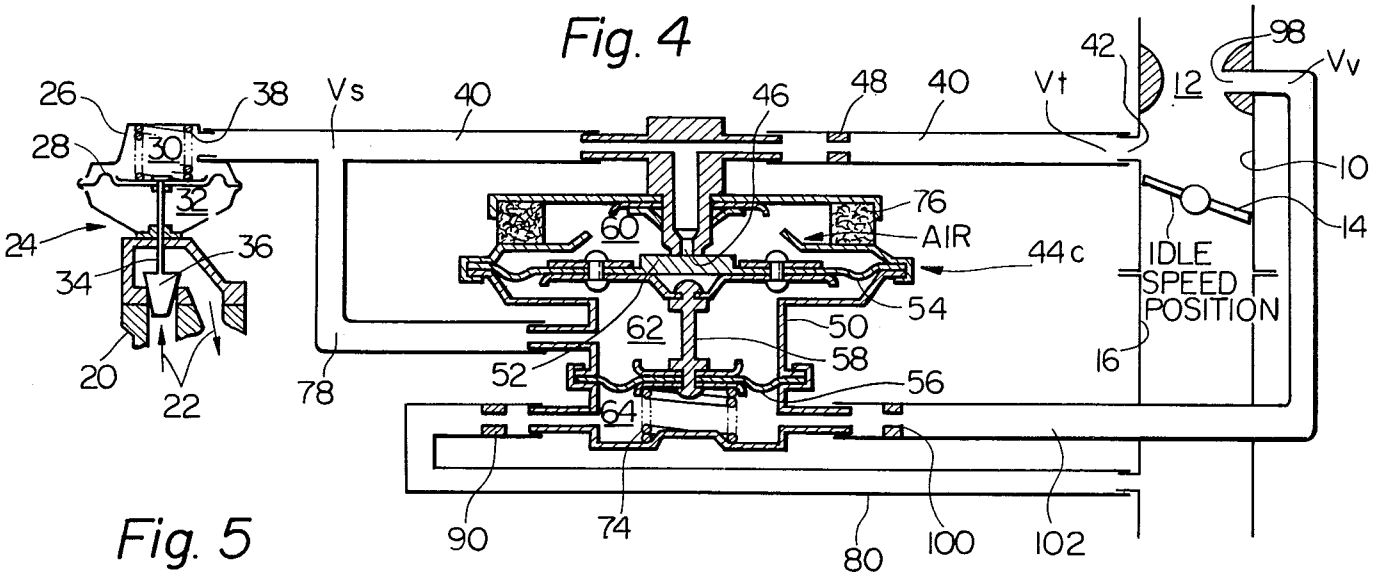
FIG. 4 illustrates a fourth embodiment of the present invention.

The fourth embodiment shown in FIG. 4 is substantially the same as the three embodiment shown in FIG. 3 except that a third chamber 64 is fluidly connected, instead of to the second vacuum port 92, to a third vacuum port 98 by way of a flow restricting means 100 provided in a conduit 102. The third vacuum port 98 communicates with venturi 12.

It is to be noted regarding the third embodiment shown in FIG. 3 that the second vacuum port 92 is disposed on the vacuum side of the throttle valve 14 when the throttle valve 14 is positioned for high speed operation, including coasting operation at high engine speed and cruising operating ranging from 60km/h to 80km/h so that vacuum at the port 92 ($V_{ta}$) is substantially the same value as the vacuum ($V_t$) at the port 42 during coasting operation at high engine speed and cruising operating ranging from 60km/h to 80km/h. It follows that the vacuum ($V_{ta}$) is high during high speed operation.

It is to be noted regarding the fourth embodiment shown in FIG. 4 that vacuum at the venturi 12 ($V_v$), the venturi vacuum, is high during high speed operation.

It will now be understood that the operation of the third embodiment or fourth embodiment is substantially the same as that of the first embodiment because during high engine speed operation, vacuum in the third chamber 64 is high due to the introduction of the vacuum $V_{ta}$ or $V_v$ (venturi vacuum) thereby applying a great downward force to disc-like valve member 52.

Figure 6:
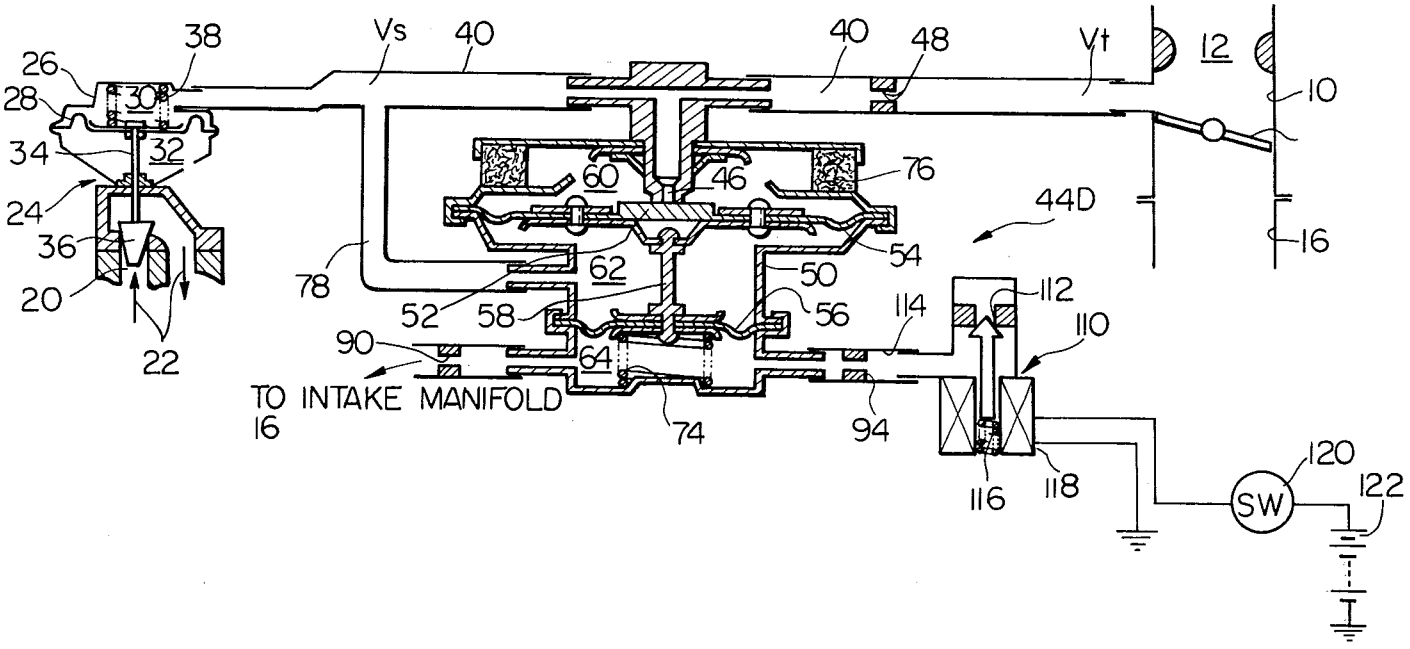
FIG. 6 illustrates a fifth embodiment of the present invention.

The fifth embodiment shown in FIG. 6 is substantially the same as the third embodiment shown in FIG. 3 in that a third chamber 64 is vented through a flow restricting means 94 during operation conditions except high speed operation as will be more precisely explained hereinafter in the case of the embodiment shown in FIG. 6 in a similar manner to the embodiment shown in FIG. 3, but different from the same in that a modified air bleed means 44D employs, instead of the vacuum port 92, a solenoid valve means 110 for normally opening a vent 112 fluidly connected to the flow restricting means 94 to permit the bleed of air to the third chamber 64 (see the position shown in FIG. 6), but for closing the vent 112 to prevent the bleed of air to the chamber 64 during high speed operation of the engine.

Describing more specifically the embodiment shown in FIG. 6, the solenoid valve means 110 is fluidly connected to the chamber 64 by way of a conduit 114 provided with the flow restricting means 94. The solenoid valve 110 is biased closed by a spring 116 and is opened when a solenoid 118 is energized against the force of the spring 116. The energization of the solenoid 118 is effected by a control circuit comprised of a condition sensing switch 120 and a battery 122. The switch 120 is normally closed and is opened during high speed operation so that during high speed operation, the bleed of air through the vent 112 and the flow restricting means 94 to the chamber 64 is prevented.

Although not shown the switch 120 may be responsive to vehicle speed, engine speed, opening degree of throttle valve, or shift position of associated transmission, in order to detect the high speed operation.

What is claimed is:

1. In an internal combustion engine having an intake system with a throttle valve and an exhaust system, an exhaust gas recirculating system comprising:

an EGR duct connecting the exhaust gases passing through the exhaust system to the intake system;

an EGR valve normally closing said EGR duct to prevent recirculation and movable by a signal vacuum applied thereto to an open position;

control means operable to provide a signal vacuum to said EGR valve including a vacuum line connecting a vacuum port communicating with the intake system above the idle speed position of the throttle valve to said EGR valve; air bleed means including a vent in said vacuum line; and flow restricting means in said vacuum line fluidly intermediate said vacuum port and vent;

said air bleed means including an air bleed control valve movable into and out of said vent to close or open the same; first means biasing said air bleed valve closed; servo means connected to said air bleed control valve for moving it to an open vent position in response to vacuum in said vacuum line intermediate said flow restricting means and EGR valve; second means for biasing said servo means in response to the engine manifold vacuum in a direction to move said air bleed control valve to an open vent position; and third means for biasing said second biasing means to vary movement of said air bleed control valve to an open vent position.

2. An exhaust gas recirculating system as claimed in claim 1, in which said third biasing means includes a variable chamber defined by said servo means, said variable chamber being fluidly connected to an engine driven air pump for the engine secondary air supply system to receive a compressed air therefrom.

3. An exhaust gas recirculating system as claimed in claim 1, in which said second and third biasing means include a variable chamber fluidly connected to the engine intake manifold and also connected to a second vacuum port communicating with the intake system above said first mentioned vacuum port.

4. An exhaust gas recirculating system as claimed in claim 1, in which said second and third biasing means include a variable chamber defined by said servo means, said variable chamber being fluidly connected to the engine intake manifold and also connected to a second vacuum port communicating with the venturi of the intake system.

5. An exhaust gas recirculating system as claimed in claim 1, in which said second and third biasing means include a variable chamber defined by said servo means, said variable chamber being fluidly connected to the engine intake manifold vacuum; and solenoid valve means for normally permitting the bleed of air to said variable chamber, but for preventing the bleed of air during a predetermined engine operating condition.

6. An exhaust gas recirculating system as claimed in claim 1, in which said air bleed control valve includes a disc-like valve member cooperating with said vent to vary the bleed of air to said vacuum line.

7. An exhaust gas recirculating system as claimed in claim 6, in which said air bleed means includes a casing; said servo means comprises a relatively large, in effective area, diaphragm, a relatively small, in effective area, diaphragm and a rod interconnecting said large and small diaphragms, said large diaphragm defining in said casing a first chamber, said large and small diaphragms defining therebetween and in said casing a second chamber, said small diaphragm defining in said casing a third chamber, said second chamber being divided by a partition into a first subchamber adjacent said large diaphragm and into a second subchamber adjacent said small diaphragm; and said disc-like valve member is fixed centrally to said large diaphragm, said first chamber communicating with the atmosphere, said first subchamber being fluidly connected to said vacuum line at a location intermediate said vent and EGR valve, said second subchamber being fluidly connected to an engine driven air pump for the engine secondary air supply system to receive a compressed air therefrom, said third chamber being fluidly connected to the engine intake manifold.

8. An exhaust gas recirculating system as claimed in claim 7, in which said air bleed means includes an air filter by way of which said first chamber communicates with the atmosphere.

9. An exhaust gas recirculating system as claimed in claim 7, in which said air bleed means includes the engine air cleaner to which said first chamber is fluidly connected.

10. An exhaust gas recirculating system as claimed in claim 6, in which said air bleed means includes a casing; said servo means comprises a relatively large, in effective area, diaphragm, a relatively small, in effective areas, diaphragm and a rod interconnecting said large and small diaphragms, said large diaphragm defining in said casing a first chamber, said large and small diaphragm defining therebetween and in said casing a second chamber, said small diaphragm defining in said casing a third chamber; and said disc-like valve member is fixed centrally to said large diaphragm, said first chamber being fluidly connected to an engine driven air pump for the engine secondary air supply system to receive a compressed air therefrom, said second chamber being fluidly connected to said vacuum line at a location intermediate said vent and EGR valve, said third chamber being fluidly connected to the engine intake manifold.

11. An exhaust gas recirculating system as claimed in claim 6, in which said air bleed means includes a casing; said servo means comprises a relatively large, in effective area, diaphragm, a relatively small, in effective area, diaphragm and a rod interconnecting said large and small diaphragms, said large diaphragm defining in said casing a first chamber, said large and small diaphragm defining therebetween and in said casing a second chamber, said small diaphragm defining in said casing a third chamber; and said disc-like valve member is fixed centrally to said large diaphragm, said first chamber communicating with the atmosphere, said second chamber being fluidly connected to said vacuum line at a location intermediate said vent and EGR valve, said third chamber being fluidly connected to the engine intake manifold by way of a flow restricting means and also connected to a second vacuum port by way of a flow restricting means, said second vacuum port communicating with the intake system above said first mentioned vacuum port.

12. An exhaust gas recirculating system as claimed in claim 11, in which said air bleed means includes an air filter by way of which said first chamber communicates with the atmosphere.

13. An exhaust gas recirculating system as claimed in claim 11, in which said bleed means includes the engine air cleaner to which said first chamber is fluidly connected.

14. An exhaust gas recirculating system as claimed in claim 6, in which said air bleed means includes a casing;

said servo means comprises a relatively large, in effective area, diaphragm, a relatively small, in effective area, diaphragm and a rod interconnecting said large and small diaphragms, said large diaphragm defining in said casing a first chamber, said large and small diaphragms defining therebetween and in said casing a second chamber, said small diaphragm defining in said casing a third chamber; and said disc-like valve member is fixed centrally to said large diaphragm, said first chamber communicating with the atmosphere, said second chamber being fluidly connected to said vacuum line at a location intermediate said vent and EGR valve, said third chamber being fluidly connected the engine intake manifold by way of a flow restricting means and also connected to a second vacuum port by way of a flow restricting means, said second vacuum port communicating with the venturi of said intake system.

15. An exhaust gas recirculating system as claimed in claim 14, in which said air bleed means includes an air filter by way of which said first chamber communicates with the atmosphere.

16. An exhaust gas recirculating system as claimed in claim 14, in which said air bleed means includes the engine air cleaner to which said first chamber is fluidly connected.

17. An exhaust gas recirculating system as claimed in claim 6, in which said air bleed means includes a casing; said servo means comprises a relatively large, in effective area, diaphragm, a relatively small, in effective area, diaphragm and a rod interconnecting said large and small diaphragms, said large diaphragm defining in said casing a first chamber, said large and small diaphragms defining therebetween and in said casing a second chamber, said small diaphragm defining in said casing a third chamber; and said disc-like valve member is fixed centrally to said large diaphragm, said first chamber communicating with the atmosphere, said second chamber being fluidly connected to said vacuum line at a location intermediate said vent and EGR valve, said third chamber being fluidly connected to the engine intake manifold by way of a flow restricting means and also connected to a second vent by way of a flow restrictor, said air bleed means including solenoid valve means for normally opening said second vent to permit the bleed of air to said third chamber, but for closing said second vent to prevent the bleed of air during a predetermined engine operating condition.

18. An exhaust gas recirculating system as claimed in claim 17, in which said air bleed means includes an air filter by way of which said first chamber communicates with the atmosphere.

19. An exhaust gas recirculating system as claimed in claim 17, in which said air bleed means includes the engine air cleaner to which said first chamber is fluidly connected.

* * * * *